US010862243B2

(12) United States Patent
Nishiyama

(10) Patent No.: US 10,862,243 B2
(45) Date of Patent: Dec. 8, 2020

(54) CONNECTOR

(71) Applicant: Yazaki Corporation, Tokyo (JP)

(72) Inventor: Noritaka Nishiyama, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 16/579,281

(22) Filed: Sep. 23, 2019

(65) Prior Publication Data

US 2020/0136310 A1 Apr. 30, 2020

(30) Foreign Application Priority Data

Oct. 24, 2018 (JP) ..... 2018-200359

(51) Int. Cl.

*H01R 13/635* (2006.01)
*H01R 13/64* (2006.01)
*H01R 13/639* (2006.01)
*H01R 13/627* (2006.01)

(52) U.S. Cl.

CPC ..... *H01R 13/635* (2013.01); *H01R 13/6272* (2013.01); *H01R 13/639* (2013.01); *H01R 13/64* (2013.01)

(58) Field of Classification Search

CPC ..... H01R 13/6272; H01R 13/635
USPC ..... 439/352
See application file for complete search history.

(56) References Cited

U.S. PATENT DOCUMENTS 7,275,951 B2 * 10/2007 Shigeta ..... H01R 13/6271 439/352
7,442,065 B2 * 10/2008 Kuwayama ..... H01R 13/6272 439/352
8,678,846 B2 * 3/2014 Hitchcock ..... H01R 13/641 439/352
8,926,355 B2 * 1/2015 Heil ..... H01R 13/641 439/352
9,142,919 B2 * 9/2015 Osada ..... H01R 13/642
9,742,116 B1 * 8/2017 Nishiyama ..... H01R 13/6272
2010/0111597 A1 5/2010 Kodama et al.
2020/0136310 A1 * 4/2020 Nishiyama ..... H01R 13/641
2020/0203890 A1 * 6/2020 Ohfuku ..... H01R 13/641

FOREIGN PATENT DOCUMENTS

JP 5341477 B2 11/2013

* cited by examiner

*Primary Examiner* — Neil Abrams
(74) *Attorney, Agent, or Firm* — Banner & Witcoff, Ltd.

(57) ABSTRACT

A connector including a male housing and a female housing is provided. A beak portion of the male housing has a push-back surface provided on a front side of the male housing with a top portion of the beak portion as a boundary and inclined outward gradually toward a rear side of the male housing, and a pull-in surface provided on the rear side of the male housing with the portion of the beak portion as a boundary and inclined inward gradually toward the rear side of the male housing. When the locking claw of the locking arm of the fitting assurance member reaches a boundary between the locking projection of the male housing and the lock piece of the female housing, the pressing claw of the elastic arm in the fitting assurance member is disposed on the pull-in surface side over the top portion of the beak portion.

4 Claims, 15 Drawing Sheets

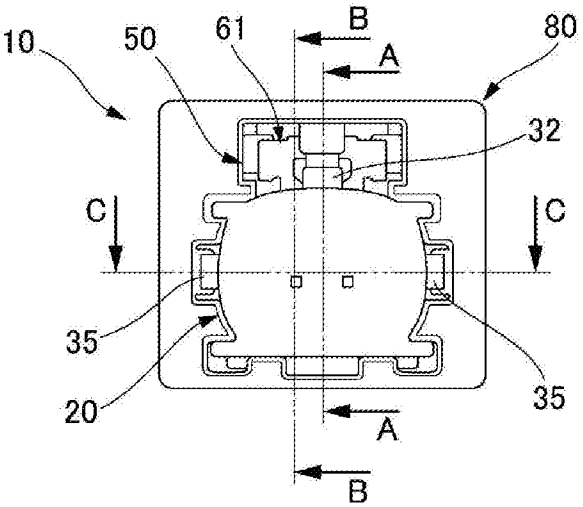
FIG.2A
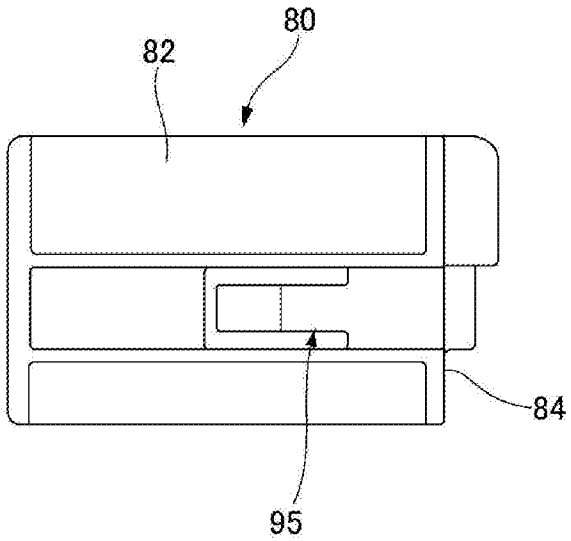
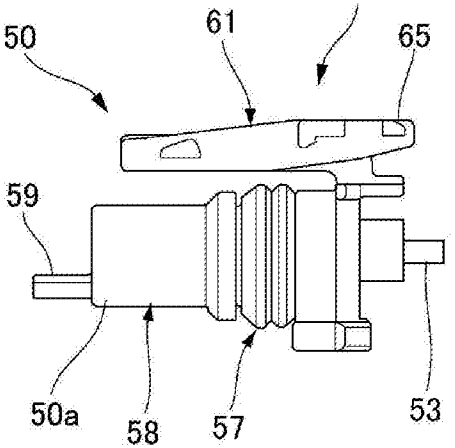
FIG.2B
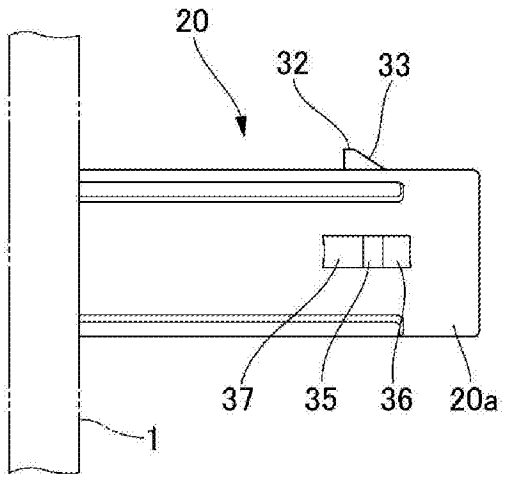

CONNECTOR

CROSS-REFERENCE TO RELATED APPLICATIONS

This application is based on and claims priority under 35 USC 119 from Japanese Patent Application No. 2018-200359 filed on Oct. 24, 2018, the contents of which are incorporated herein by reference.

TECHNICAL FIELD

The present invention relates to a connector.

BACKGROUND ART

There is a connector provided with a connector position assurance (CPA) function for assuring a fitting state of housings by a CPA member (see, for example, Patent Literature 1). In the connector having the CPA function, the lock portion of the lock arm of the housing is pushed by the claw portion of the elastic arm of the fitting assurance member by assembling the fitting assurance member into the housing having the lock arm and fitting the fitting assurance member to the mating housing. Then, after the lock portion of the lock arm rides over and locks the locking projection of the mating housing, the claw portion of the elastic arm rides over the locking projection and the lock portion to lock the lock portion. As a result, the locking state of the mating housing with the locking projection by the lock portion of the lock arm of the housing is maintained by the fitting assurance member. In the connector, a repulsive force is generated when the claw portion of the elastic arm rides over the locking projection of the mating housing. Therefore, when the fitting operation is stopped in the halfway fitting state, the housings are separated from each other, and the halfway fitting is suppressed.

CITATION LIST

Patent Literature

Patent Literature 1: Japanese Patent No. 5341477

SUMMARY OF INVENTION

When the claw portion of the elastic arm rides over the locking projection and the lock portion to lock the lock portion after the locking projection of the mating housing is locked by the lock portion of the lock arm, the claw portion passes through the boundary between the locking projection and the lock portion. Then, a feeling of hooking when the claw portion passes through the boundary between the locking projection and the lock portion is transmitted to the operator who performs the fitting operation, and the feeling is recognized as the attachment completion of the fitting assurance member, and the fitting operation of the housings may be delayed.

The present invention has been made in view of the above-described circumstances, and an object thereof is to provide a connector capable of smoothly performing a fitting operation between housings.

In order to achieve the above object, the connector according to the present invention is characterized by the following (1) to (4).

(1) A connector including a first housing, a second housing that is fitted to the first housing, and a fitting assurance member that is assembled to the second housing to assure a fitting state of the second housing with respect to the first housing, in which the first housing includes a locking projection and a beak portion which respectively project outward from an outer peripheral surface, in which the second housing includes a lock arm having a lock piece locked with the locking projection by getting over the locking projection when the second housing is fitted with the first housing, in which the fitting assurance member includes a locking arm having a locking claw for riding over and locking the locking projection and the lock piece that locks the locking projection while pressing the lock piece to ride over the locking projection, and an elastic arm that elastically deforms since the pressing claw at the front end is brought into contact with the beak portion to generate a repulsive force in a direction separating from the first housing during fitting of the second housing with respect to the first housing, in which the beak portion includes a push-back surface inclined outward gradually toward the rear side of the first housing on a front side of the first housing with the top portion as a boundary, and a pull-in surface inclined inward gradually toward the rear side of the first housing on the rear side of the first housing, and in which the pressing claw of the elastic arm is disposed on the pull-in surface side over the top portion of the beak portion when the locking claw of the locking arm reaches a boundary between the locking projection and the lock piece that locks the locking projection.

(2) The connector according to (1), in which an outer surface of the lock piece that has locked the locking projection is disposed inside the top portion of the locking projection.

(3) The connector according to (1) or (2), in which the outer surface of the lock piece is an inclined surface that inclines inward gradually toward the front side of the second housing.

(4) The connector according to any one of (1) to (3), in which the first housing is provided with a pair of the beak portions on opposite sides of an outer peripheral surface, and the fitting assurance member is provided with a pair of the elastic arms having the pressing claws respectively in contact with the beak portions.

According to the connector having the configuration (1), when the second housing is fitted to the first housing and the locking claw of the locking arm reaches the boundary between the locking projection and the lock piece, the pressing claw of the elastic arm of the fitting assurance member is disposed on the pull-in surface side over the top portion of the beak portion. As a result, the pressing claw is guided along the pull-in surface, whereby the elastic arm is pulled toward the first housing. Therefore, the feeling of hooking when the locking claw of the locking arm passes through the boundary between the locking projection and the lock piece can be made less likely to be felt by the operator. As a result, fitting operation can be smoothly performed by the operator.

According to the connector having the configuration (2), since the outer surface of the lock piece that locks the locking projection is disposed inside the top portion of the locking projection, the locking claw of the locking arm passes smoothly between the locking projection and the lock piece. As a result, the feeling of hooking can be made less likely to be felt by the operator.

According to the connector having the configuration (3), the locking claw of the locking arm over the boundary between the locking projection and the lock piece can be guided to the front of the second housing by the inclined outer surface of the lock piece that is inclined inward gradually toward the front side of the second housing. As a result, the feeling of hooking can be made less likely to be felt by the operator.

According to the connector having the configuration (4), the pressing claws of the pair of elastic arms of the fitting guarantee member is in contact with the pair of beak portions of the first housing, so that the repulsive force and the pull-in force can be generated in a well-balanced manner.

According to the present invention, a connector capable of smoothly performing a fitting operation between housings.

The present invention has been briefly described above. Details of the present invention will be further clarified by reading through modes for carrying out the invention (hereinafter, referred to a "embodiments") described below with reference to the accompanying drawings.

BRIEF DESCRIPTION OF DRAWINGS

FIGS. 2A and 2B are views showing the connector according to the present embodiment, FIG. 2A is a front view from a male housing, and FIG. 2B is a side view of the male housing, a female housing, and a fitting assurance member.

FIG. 3A is a cross-sectional view taken along line A-A in FIG. 2A, and FIG. 3B is a cross-sectional view taken along line B-B in FIG. 2A.

FIG. 6A is a perspective view, FIG. 6B is a perspective view cut along the vertical direction, and FIG. 6C is a perspective view cut along the horizontal direction.

FIG. 7A is a cross-sectional view taken along line A-A in FIG. 2A, FIG. 7B is a cross-sectional view taken along line B-B in FIG. 2A, and FIG. 7C is a cross-sectional view taken along line C-C in FIG. 2A.

FIG. 8A is a cross-sectional view taken along line A-A in FIG. 2A, FIG. 8B is a cross-sectional view taken along line B-B in FIG. 2A, and FIG. 8C is a cross-sectional view taken along line C-C in FIG. 2A.

FIG. 9A is a cross-sectional view taken along line A-A in FIG. 2A, FIG. 9B is a cross-sectional view taken along line B-B in FIG. 2A, and FIG. 9C is a cross-sectional view taken along line C-C in FIG. 2A.

FIG. 10A is a cross-sectional view taken along line A-A in FIG. 2A, FIG. 10B is a cross-sectional view taken along line B-B in FIG. 2A, and FIG. 10C is a cross-sectional view taken along line C-C in FIG. 2A.

FIG. 11A is a cross-sectional view taken along line A-A in FIG. 2A, FIG. 11B is a cross-sectional view taken along line B-B in FIG. 2A, and FIG. 11C is a cross-sectional view taken along line C-C in FIG. 2A.

FIG. 12A is a cross-sectional view taken along line A-A in FIG. 2A, FIG. 12B is a cross-sectional view taken along line B-B in FIG. 2A, and FIG. 12C is a cross-sectional view taken along line C-C in FIG. 2A.

FIG. 13A is a cross-sectional view taken along line A-A in FIG. 2A, FIG. 13B is a cross-sectional view taken along line B-B in FIG. 2A, and FIG. 13C is a cross-sectional view taken along line C-C in FIG. 2A.

FIG. 14A is a cross-sectional view taken along line A-A in FIG. 2A, FIG. 14B is a cross-sectional view taken along line B-B in FIG. 2A, and FIG. 14C is a cross-sectional view taken along line C-C in FIG. 2A.

DESCRIPTION OF EMBODIMENTS

Hereinafter, an embodiment of the present invention will be described with reference to the drawings.

Figure 1:
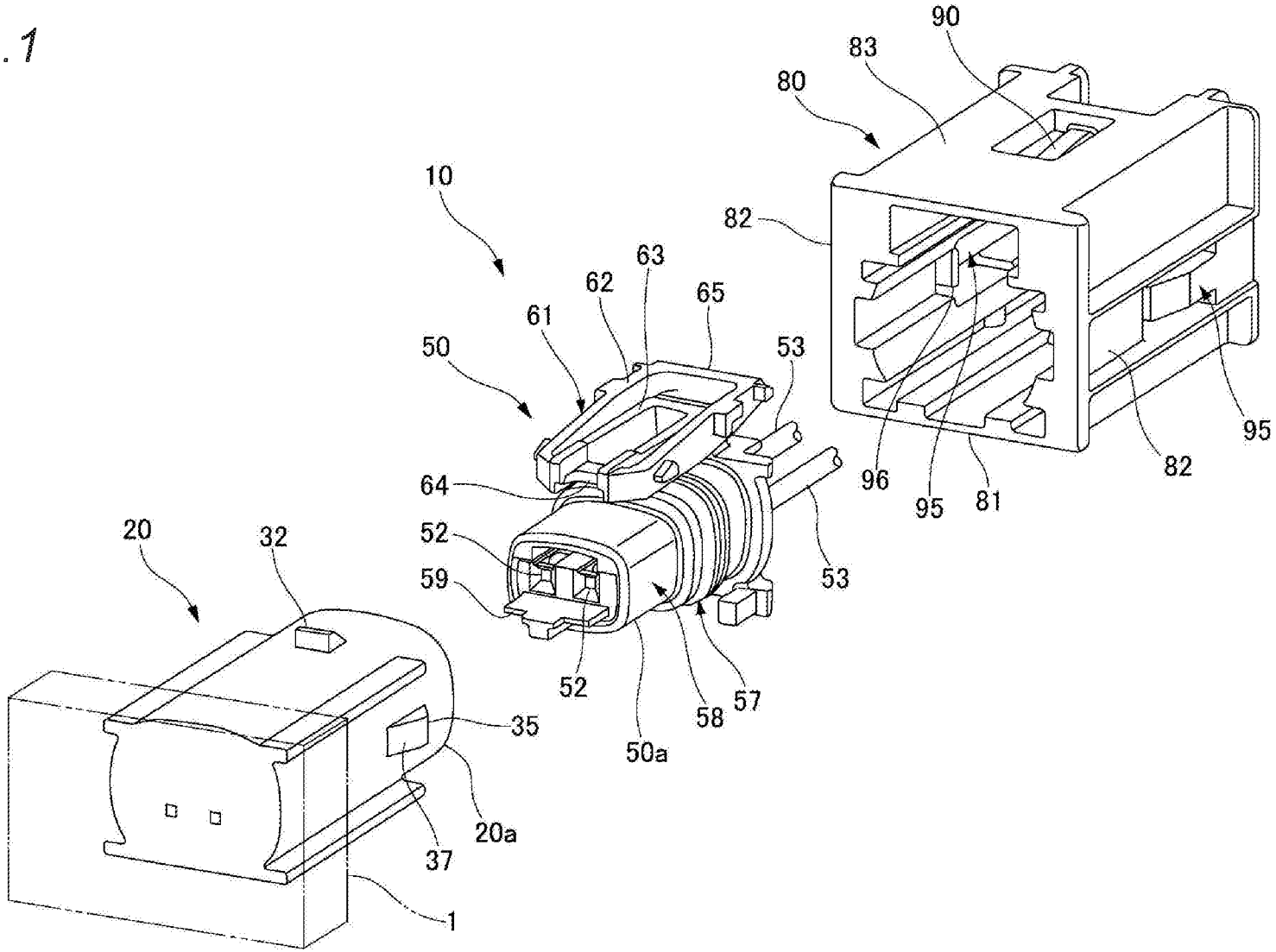
FIG. 1 is an exploded perspective view showing a connector according to the present embodiment.
Figures 3A, 3B, 3C:
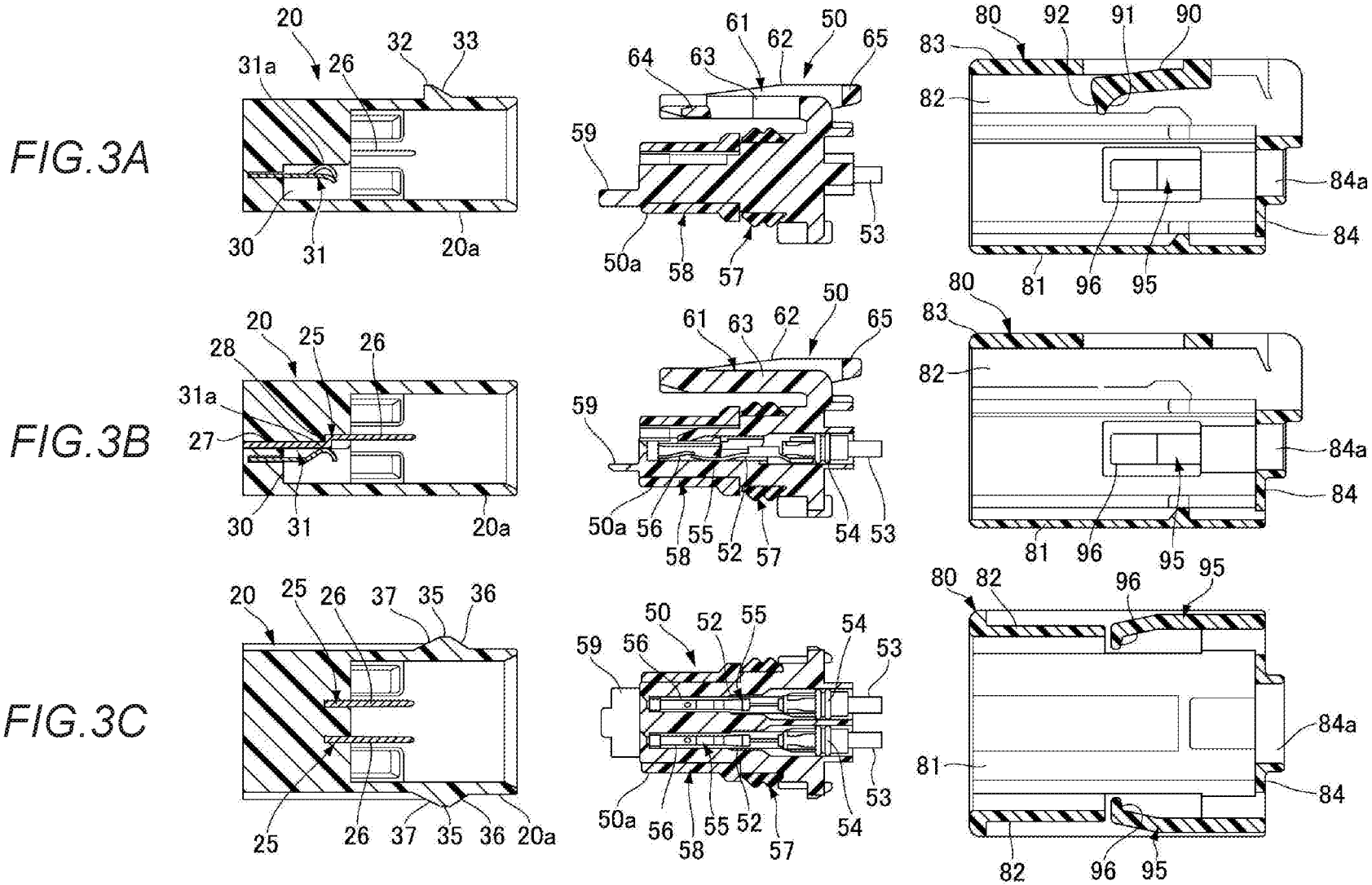
FIGS. 3A to 3B are views showing the connector according to the present embodiment.
FIG. 3C is a cross-sectional view taken along line C-C in FIG. 2A.

FIG. 1 is an exploded perspective view showing a connector according to the present embodiment. FIGS. 2A and 2B are views showing the connector according to the present embodiment, FIG. 2A is a front view from a male housing side, and FIG. 2B is a side view of the male housing, a female housing, and a fitting assurance member. FIGS. 3A to 3B are views showing the connector according to the present embodiment, FIG. 3A is a cross-sectional view taken along line A-A in FIG. 2A, and FIG. 3B is a cross-sectional view taken along line B-B in FIG. 2A, and FIG. 3C is a cross-sectional view taken along line C-C in FIG. 2A.

As shown in FIGS. 1 to 3C, a connector 10 according to the present embodiment includes a male housing (first housing) 20, a female housing (second housing) 50 fitted to the male housing 20, and a fitting assurance member 80 to be assembled to the female housing 50. The male housing 20 has a fitting portion 20*a*, and the female housing 50 has a connecting portion 50*a*. In the connector 10, the male housing 20 and the female housing 50 are joined to each other by fitting the connecting portion 50*a* of the female housing 50 into the fitting portion 20*a* of the male housing 20. The connector 10 is a connector which has a connector position assurance (CPA) function for assuring a fitting state of the female housing with respect to the male housing 20 by a fitting assurance member 80. The connector 10 constitutes, for example, an electrical connector of an on-vehicle airbag system provided in an automobile or the like. The male housing 20 is provided, for example, in a device 1 such as an inflator of an airbag system.

Figure 4:
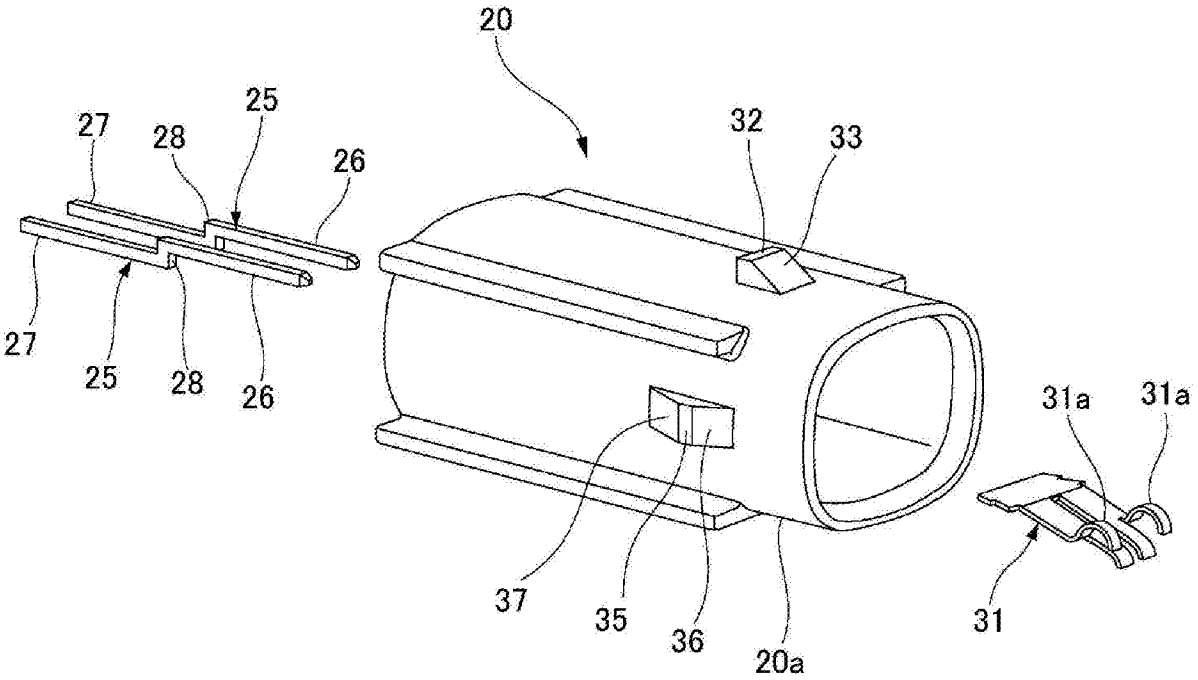
FIG. 4 is an exploded perspective view of the male housing.

FIG. 4 is an exploded perspective view of the male housing.

As shown in FIGS. 3A to 3C and FIG. 4, the male housing 20 is formed of a synthetic resin and has a tubular fitting portion 20*a*. The male housing 20 is provided with two male terminals (connecting terminals) 25. The male terminals 25 are formed by bending an elongated bar made of a conductive metal material such as copper or copper alloy, for example. The male terminals 25 include tab portions 26 extending to the front-end side of the male housing 20, wiring portions 27 extending to the rear end side of the male housing 20, and connection portions 28 connecting the tab portions 26 and the wiring portions 27. The male terminals 25 are provided integrally with the male housing 20 by insert molding, for example. In the male terminals 25, the wiring portions 27 and the connection portions 28 are buried in the male housing 20, and the tab portions 26 are disposed inside the fitting portion 20*a* of the male housing 20. The wiring portions 27 of the male terminals 25 are exposed at the rear end surface of the male housing 20, and the wirings on the side of the device 1 are connected to the wiring portions 27.

The male housing 20 includes an accommodating recessed portion 30 at a position adjacent to the tab portions 26 of the male terminals 25, and a short terminal 31 is accommodated in the accommodating recessed portion 30. The short terminal 31 is, for example, a plate-like member made of a conductive metal material such as copper or a copper alloy, and includes contact points 31*a*. In the short terminal 31, the contact points 31*a* are in contact with the wiring portions 27 of the male terminals 25 in a non-fitting state in which the female housing 50 is not fitted to the male housing 20. As a result, the male terminals 25 are electrically connected to each other at the short terminal 31, and, for example, the circuit on the inflator side of the airbag system is short-circuited. Thus, for example, in a circuit on the inflator side, when the warning light is turned on, it is warned that the female housing 50 is not properly fitted to the male housing 20.

The male housing 20 includes a locking projection 32 at an upper portion thereof. The locking projection 32 is formed at a central position in the width direction of the upper portion of the male housing 20. The locking projection 32 projects from the outer peripheral surface of the male housing 20, and a guide surface 33 inclined upward gradually toward the rear side of the male housing 20 is formed on the front side of a fitting direction (hereinafter, simply referred to as a fitting direction) with respect to the female housing 50.

The male housing 20 includes a pair of beak portions 35 projecting outward on both side portions of the outer peripheral surface of the male housing 20. The beak portions 35 includes push-back surfaces 36 on the front side of the male housing 20 and pull-in surfaces 37 on the rear side of the male housing 20. The push-back surfaces 36 are inclined surfaces inclined outward gradually toward the rear of the male housing 20, and the pull-in surfaces 37 are inclined surfaces inclined inward gradually toward the rear of the male housing 20.

Figure 5:
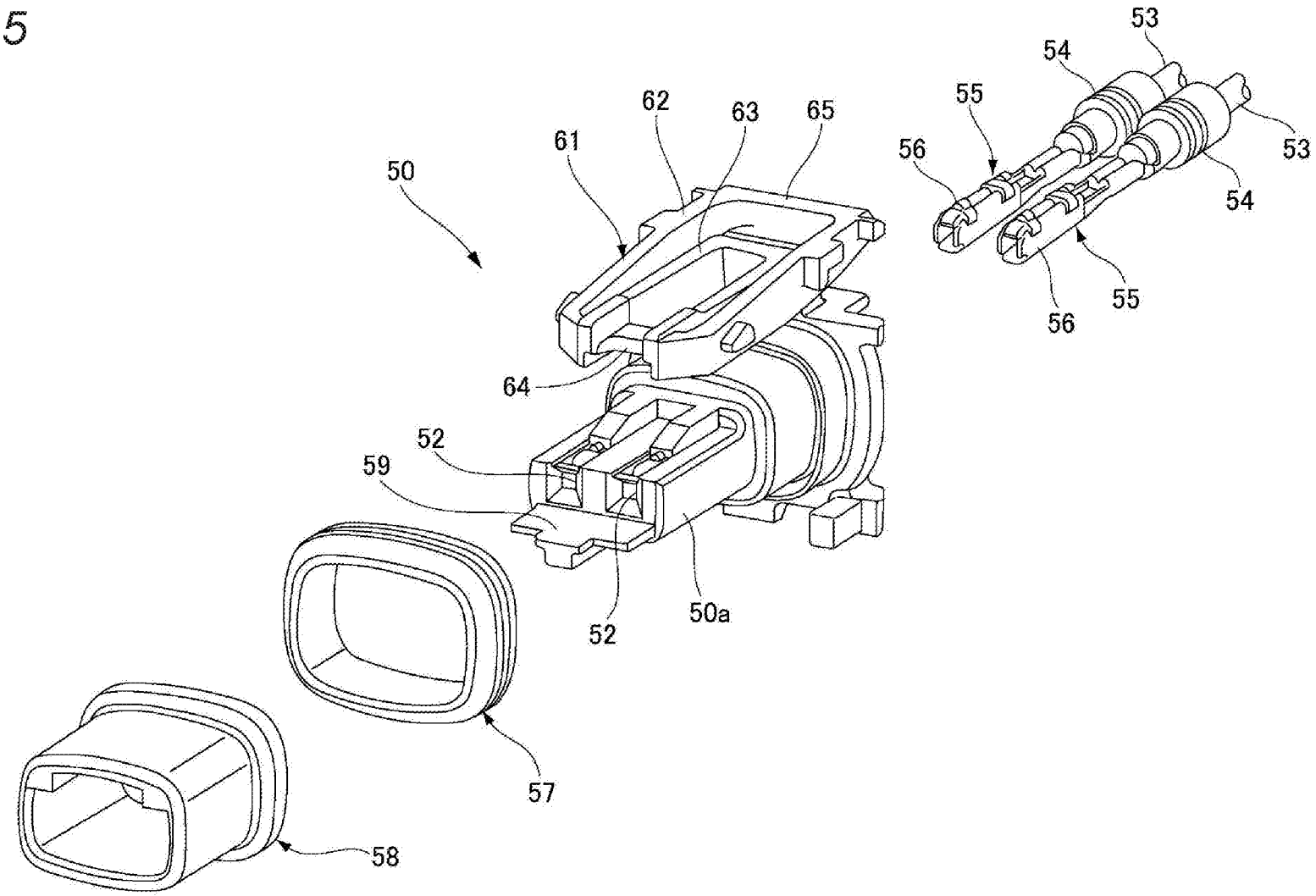
FIG. 5 is an exploded perspective view of the female housing.

FIG. 5 is an exploded perspective view of the female housing.

As shown in FIGS. 3A to 3C and FIG. 5, the female housing 50 is formed of a synthetic resin, and a connecting portion 50*a* is protruded. Two terminal accommodating chambers 52 are formed in the connecting portion 50*a*. Female terminals (connecting terminals) 55 connected to end portions of electric wires 53 are accommodated in the terminal accommodating chambers 52, and the electric wires 53 are drawn out from the rear end of the female housing 50. Seal members 54 attached to the electric wires 53 are fitted into the terminal accommodating chambers 52 from the rear end side of the female housing 50. As a result, the terminal accommodating chambers 52 of the female housing 50 accommodating the female terminals 55 are water-stopped.

The female terminals 55 are formed of, for example, a conductive metal material such as copper or a copper alloy, and are crimped to and connected to the electric wires 53. The female terminals 55 include electrical connecting portions 56 formed in a tubular shape.

An annular seal member 57 is attached to the connecting portion 50*a* of the female housing 50 so as to seal junction with the male housing 20 from the front-end side. Further, a front holder 58 molded from a synthetic resin is assembled to the connecting portion 50*a*. When the front holder 58 is assembled to the connecting portion 50*a*, the seal member 57 is held by the connecting portion 50*a*. In the connecting portion 50*a*, an insulating plate portion 59 that projects forward in a fitting direction (hereinafter, simply referred to as a fitting direction) with respect to the male housing 20. The insulating plate portion 59 is formed along the arrangement direction of the female terminals 55 accommodated in the terminal accommodating chambers 52.

The female housing 50 is provided with a lock member 61 in the vicinity of the rear end of the upper portion of the female housing 50. The lock member 61 includes a swing frame portion 62 formed of a rectangular frame body, and a lock arm 63 which is connected to the front-end side of the swing frame portion 62 and is provided integrally therewith. The lock arm 63 is disposed inside the swing frame portion 62. The rear end side of the lock arm 63 is connected to the upper portion of the female housing 50. A lock piece 64 formed in a plate shape is formed at a front-end portion of the lock arm 63. The outer surface of the lock piece 64 is a flat surface. An operation portion 65 is providedon the rear end side of the swing frame portion 62. Since the operation portion 65 in the block member 61 is pressed, the lock arm 63 is elastically deformed. As a result, the lock piece 64 at the front end of the lock arm 63 is displaced in the direction away from the female housing 50.

Figure 6A:
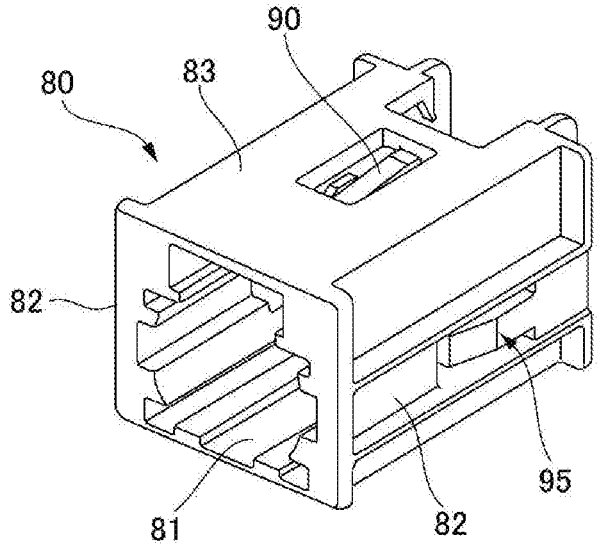
FIGS. 6A to 6C are perspective views of the fitting assurance member.
Figure 6B:
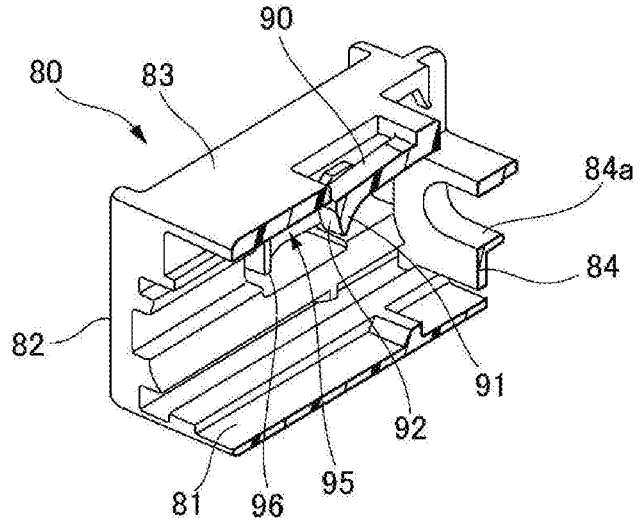
Figure 6C:
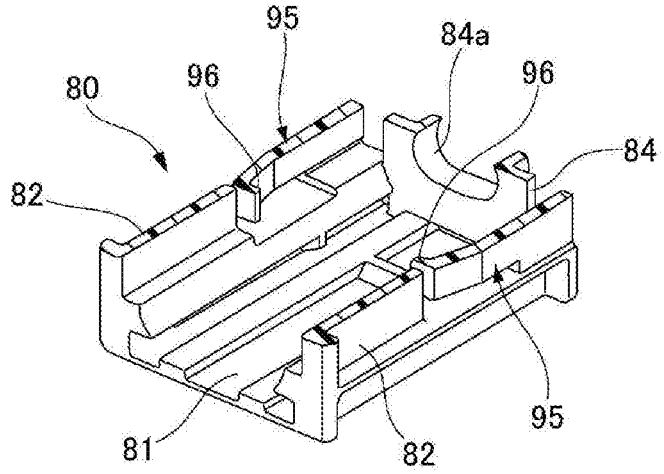

FIGS. 6A to 6C are perspective views of the fitting assurance member, FIG. 6A is a perspective view, FIG. 6B is a perspective view cut along the vertical direction, and FIG. 6C is a perspective view cut along the horizontal direction.

As shown in FIGS. 3A to 3C and FIGS. 6A to 6C, the fitting assurance member 80 is formed of a synthetic resin, and is formed into a box shape having a bottom wall portion 81, a side wall portion 82, an upper wall portion 83, and a rear wall portion 84. The fitting assurance member 80 is open on the front side, and is assembled to the female housing 50 from the rear end side. As a result, the female housing 50 is fitted into the fitting assurance member 80 to cover the periphery. An insertion hole 84*a* is formed in the rear wall portion 84 of the fitting assurance member 80, and the electric wires 53 drawn out from the rear end of the female housing 50 are passed through the insertion hole 84*a*.

The fitting assurance member 80 includes a locking arm 90 on the upper wall portion 83. The locking arm 90 extends forward of the fitting assurance member 80 and is elastically deformable. A locking claw 91 projecting toward the inside of the fitting assurance member 80 is formed at the front end of the locking arm 90. The front-end surface of the locking arm 90 is a pressing surface 92.

Further, the fitting assurance member 80 includes an elastic arm 95 on each of the two side wall portions 82. The elastic arms 95 extend forward of the fitting assurance member 80 and are elastically deformable. A pressing claws 96 projecting toward the inside of the fitting assurance member 80 are formed at the front end of the elastic arms 95.

Next, a case in which the male housing 20 and the female housing 50 are fitted in the connector 10 having the above-described structure will be described.

FIGS. 7 to 12 are views showing changes in the state of the connector during fitting operation.

First, the fitting assurance member 80 is assembled from the rear end side of the female housing 50, and the female housing 50 is fitted into the fitting assurance member 80. In this way, the pressing surface 92 of the locking arm 90 of the fitting assurance member 80 is brought into contact with the lock piece 64 formed on the lock arm 63 of the lock member 61 of the female housing 50.

Figure 7A:
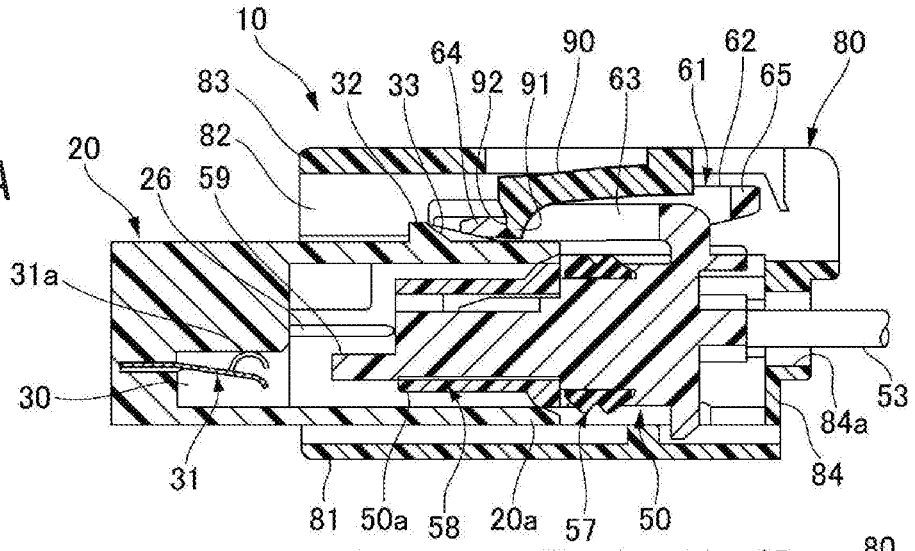
FIGS. 7A to 7C are views showing a state of the connector during a fitting operation.
Figure 7B:
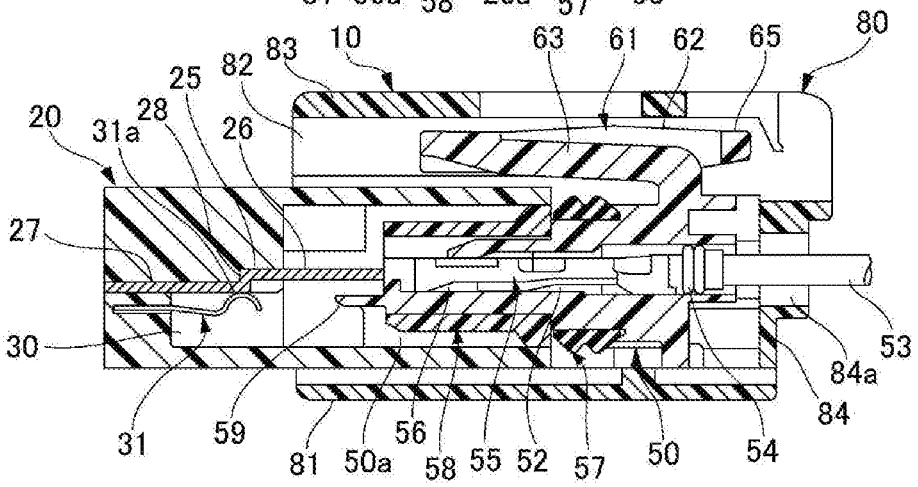
Figure 7C:
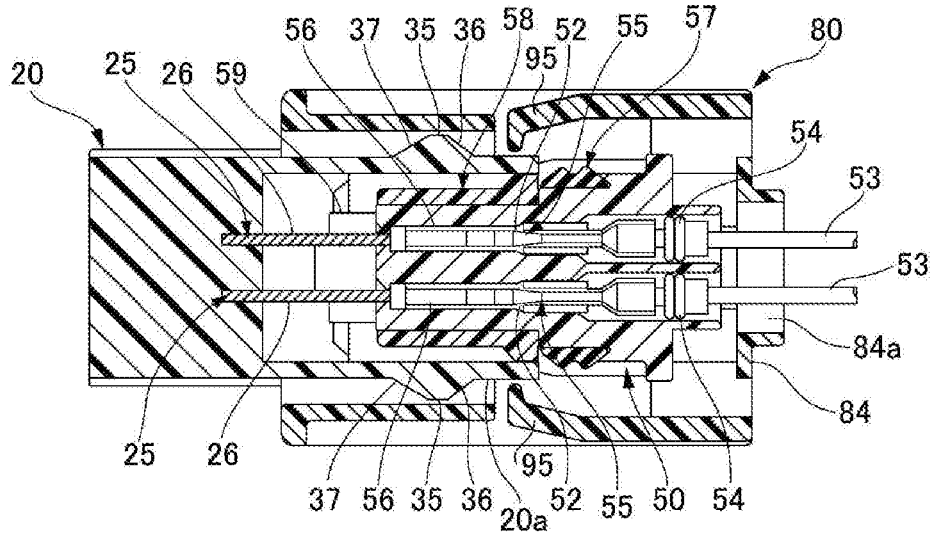

After the fitting assurance member 80 is assembled to the female housing 50, as shown in FIGS. 7A to 7C, the connecting portion 50*a* of the female housing 50 to which the fitting assurance member 80 is assembled is fitted close to the fitting portion 20*a* of the male housing 20.

Figure 8A:
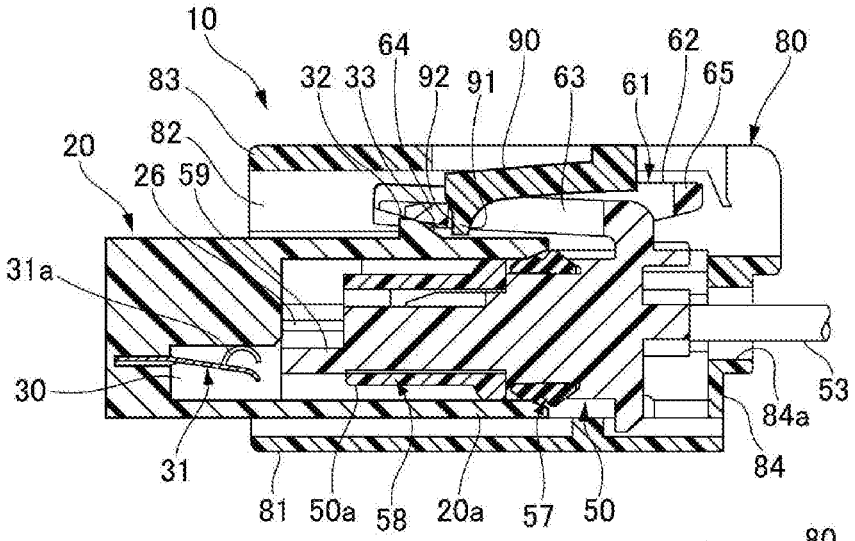
FIGS. 8A to 8C are views showing a state of the connector during the fitting operation.
Figure 8B:
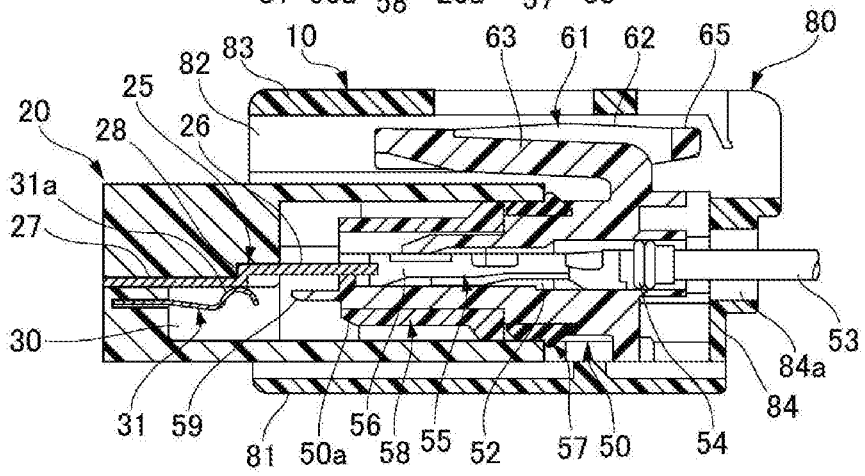
Figure 8C:
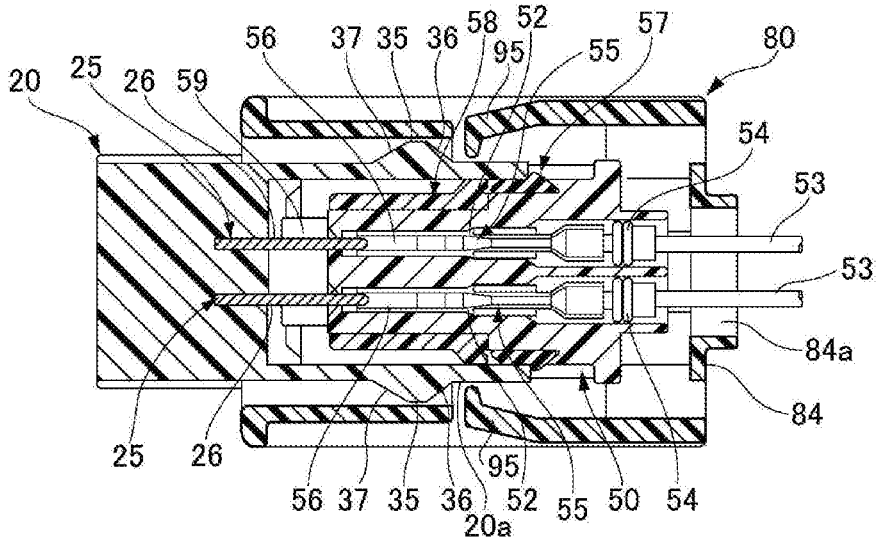

When the connecting portion 50*a* of the female housing 50 is fitted into the fitting portion 20*a* of the male housing 20, the fitting assurance member 80 temporarily locked to the female housing 50 is pushed toward the male housing 20. Then, as shown in FIG. 8A, the lock piece 64 of the lock arm 63 is brought into contact with and slides on a guide surface 33 of the locking projection 32 of the male housing 20, and starts to ride on the locking projection 32. In this halfway fitting state, as shown in FIG. 8B, the fitting portion 20*a* of the male housing 20 starts to contact with the seal member 57 of the connecting portion 50*a* of the female housing 50. The front-end portion of the tab portion 26 of the male terminal 25 is slightly inserted into the terminal accommodating chamber 52 of the female housing 50. At this time, the male terminal 25 is in a non-contact state with the female terminal 55. In the halfway fitting state, as shown in FIG. 8C, the pressing claws 96 of the elastic arms 95 of the fitting assurance member 80 are disposed on the rear sides of the beak portions 35 of the male housing 20.

In the halfway fitting state, a repulsive force is generated by the lock arm 63 in which the lock piece 64 starts to ride on the locking projection 32. Therefore, when the fitting operation is stopped in the halfway fitting state, the female housing 50 is pushed back together with the fitting assurance member 80 with respect to the male housing 20 by the repulsive force generated by the lock arm 63.

Figure 9A:
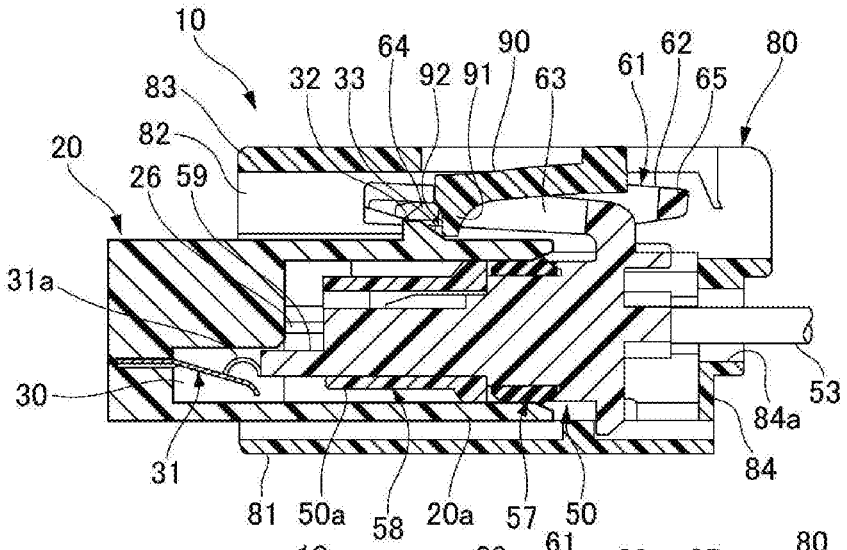
FIGS. 9A to 9C are views showing a state of the connector during the fitting operation.
Figure 9B:
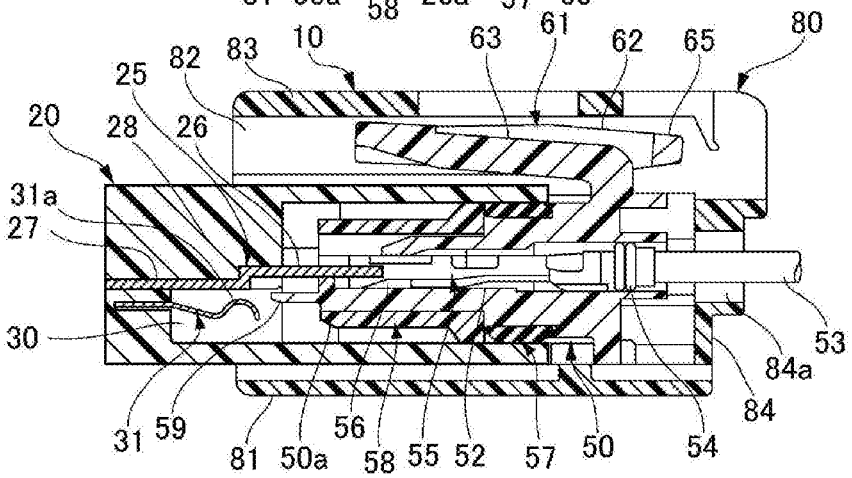
Figure 9C:
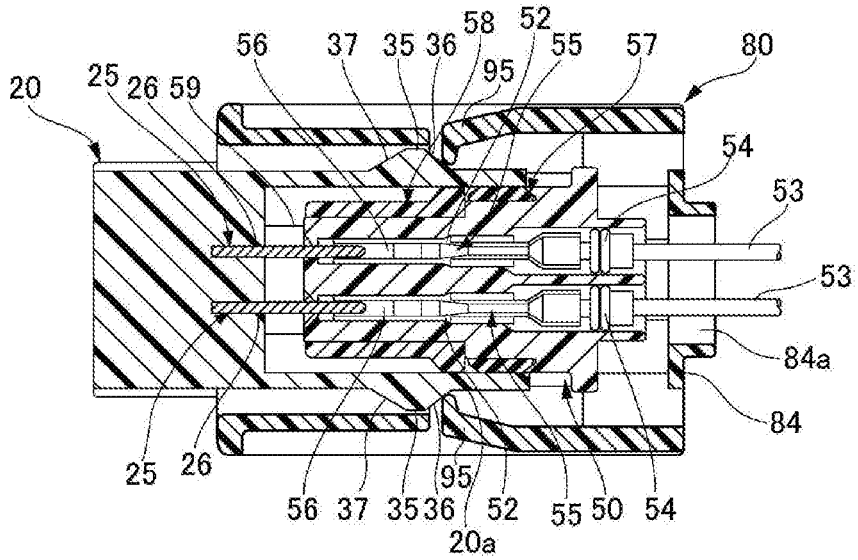

When the fitting assurance member 80 is further pushed toward the male housing 20, as shown in FIG. 9A, the lock piece 64 of the lock arm 63 rides on the locking projection 32 of the male housing 20, and the locking claw 91 of the locking arm 90 of the fitting assurance member 80 is brought into contact with the guide surface 33 of the locking projection 32. In this halfway fitting state, as shown in FIG. 9B, the fitting portion 20*a* of the male housing 20 is in close contact with the seal member 57 of the connecting portion 50*a* of the female housing 50, and the junction between the male housing 20 and the female housing 50 is sealed. The tab portion 26 of the male terminal 25 is inserted into the terminal accommodating chamber 52 of the female housing 50, but also at this time, the male terminal 25 is not in contact with the female terminal 55. In the halfway fitting state, as shown in FIG. 9C, the pressing claws 96 of the elastic arms 95 of the fitting assurance member 80 are brought into contact with the push-back surfaces 36 of the beak portions 35 of the male housing 20, and starts to ride on the beak portions 35.

In the halfway fitting state, repulsive forces are generated by the locking arm 90 in which the locking claw 91 slides on the guide surface 33 of the locking projection 32 and the elastic arms 95 in which the pressing claws 96 are brought into contact with the push-back surfaces 36 of the beak portions 35 and start to ride on the beak portions 35. Therefore, even when the fitting operation is stopped in the halfway fitting state, the female housing 50 is pushed back together with the fitting assurance member 80 with respect to the male housing 20 by the repulsive forces generated by the locking arm 90 and the elastic arms 95.

Figure 10A:
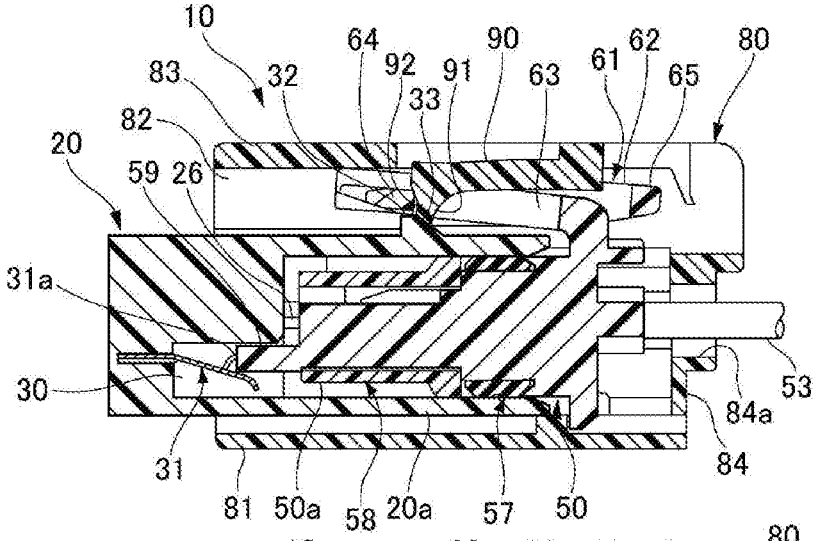
FIGS. 10A to 10C are views showing a state of the connector during the fitting operation.
Figure 10B:
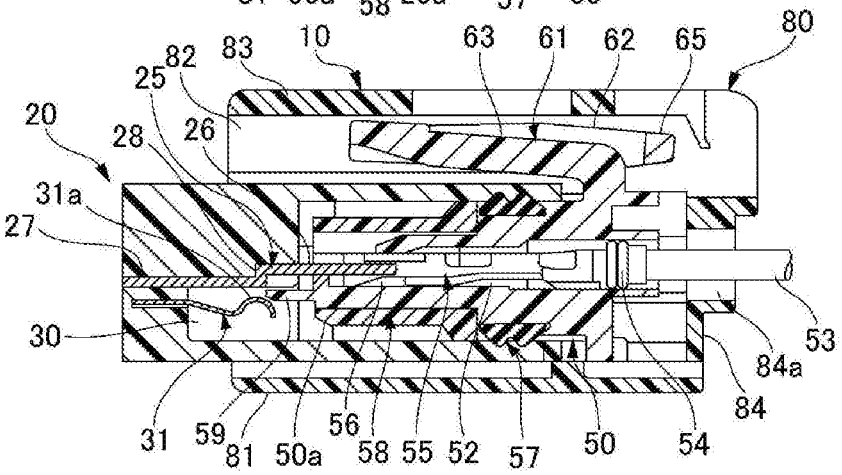
Figure 10C:
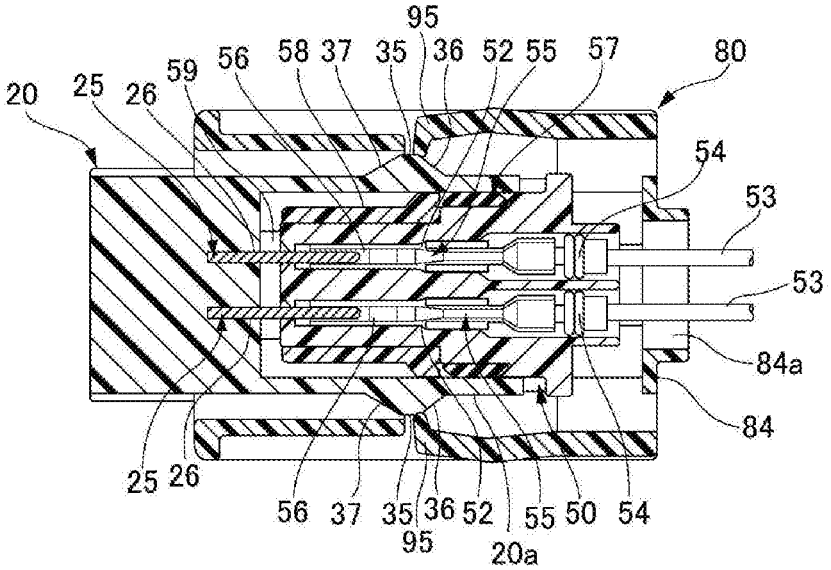

When the fitting assurance member 80 is further pushed toward the male housing 20, as shown in FIG. 10A, the lock piece 64 of the lock arm 63 substantially rides over the locking projection 32 of the male housing 20, and the locking claw 91 of the locking arm 90 slides on the guide surface 33 of the locking projection 32. In the halfway fitting state, as shown in FIG. 10B, the tab portion 26 of the male terminal 25 is inserted into the terminal accommodating chamber 52 of the female housing 50, and the male terminal 25 and the female terminal 55 are electrically connected. Further, the short terminal 31 of the male housing 20 is pushed down by the insulating plate portion 59 of the female housing 50, the contact points 31*a* are separated from the tab portions 26 of the male terminals 25, and the conduction state between the male terminals 25 by the short terminal 31 is released. As a result, for example, in the circuit on the inflator side, the warning light is turned off. In the halfway fitting state, as shown in FIG. 10C, the pressing claws 96 of the elastic arms 95 of the fitting assurance member 80 slide on the push-back surface 36 of the beak portion 35 of the male housing 20.

In the halfway fitting state, repulsive forces are generated by the locking arm 90 in which the locking claw 91 slides on the guide surface 33 of the locking projection 32 and the elastic arm 95 in which the pressing claws 96 slide on the push-back surfaces 36 of the beak portions 35. Therefore, even when the fitting operation is stopped in the halfway fitting state, the female housing 50 is pushed back together with the fitting assurance member 80 with respect to the male housing 20 by the repulsive forces generated by the locking arm 90 and the elastic arms 95.

Figure 11A:
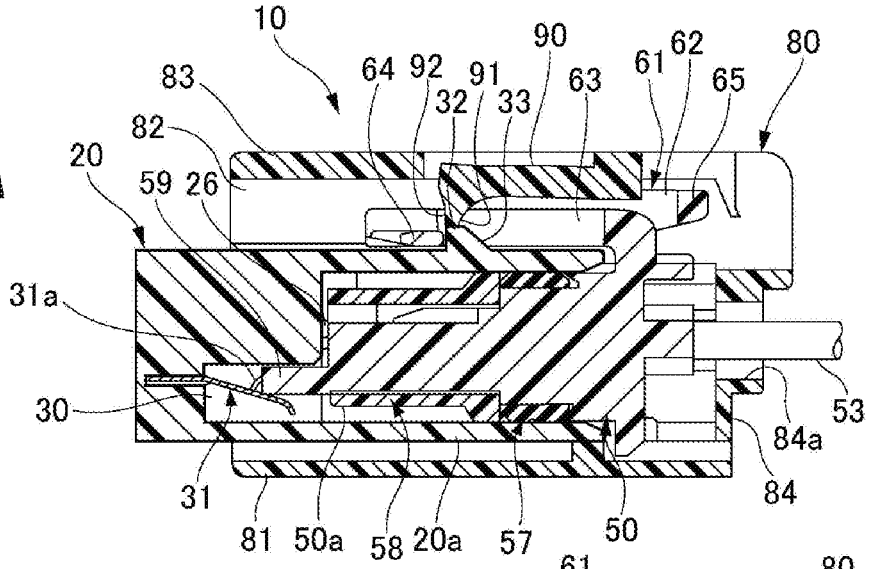
FIGS. 11A to 11C are views showing a state of the connector during the fitting operation.
Figure 11B:
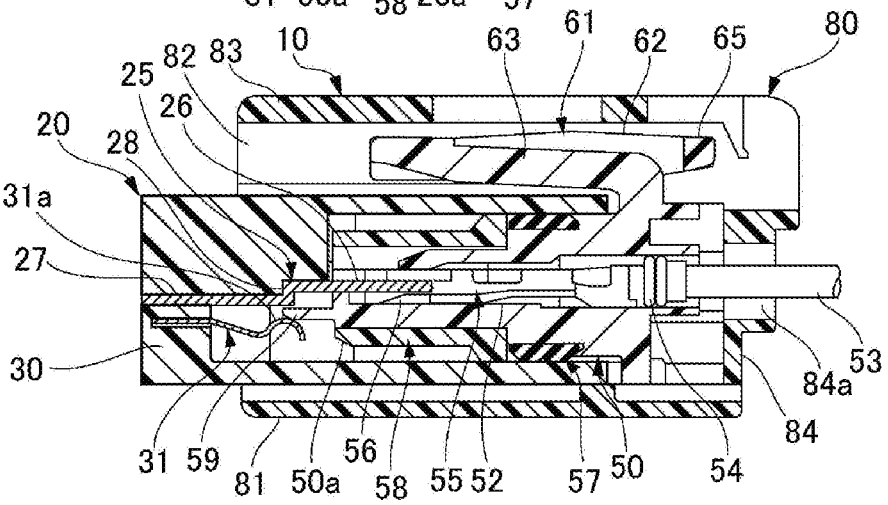
Figure 11C:
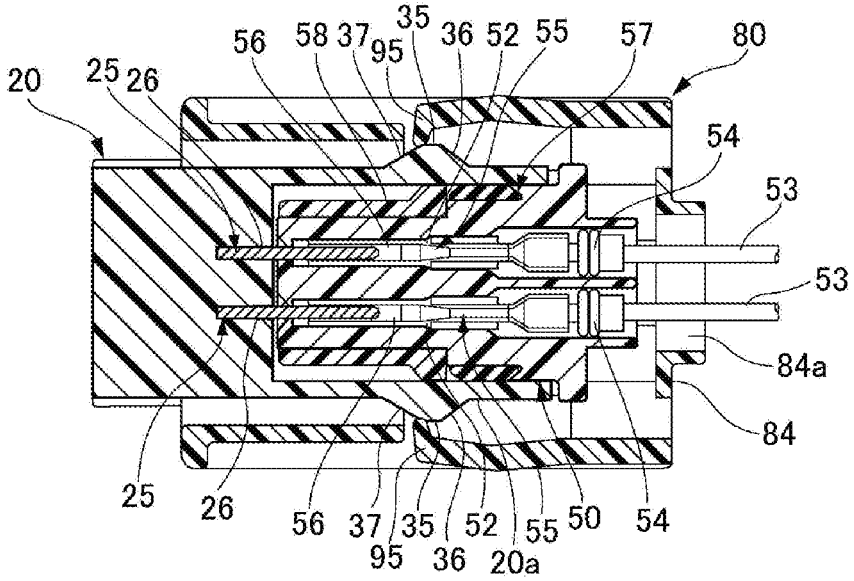

When the fitting assurance member 80 is further pushed toward the male housing 20, as shown in FIG. 11A, the lock piece 64 rides over the locking projection 32 of the male housing 20 to restore the lock arm 63, and the lock piece 64 locks the locking projection 32. The locking claw 91 of the locking arm 90 of the fitting assurance member 80 pressing the lock piece 64 on the pressing surface 92 rides on the locking projection 32 and reaches the boundary between the locking projection 32 and the lock piece 64. In this state, as shown in FIG. 11B, the female housing 50 is fitted into the male housing 20, the tab portions 26 of the male terminals 25 are inserted into the terminal accommodating chambers 52 of the female housing 50, and the male terminals 25 and the female terminals 55 are electrically connected to each other. In the fitting state, as shown in FIG. 11C, the pressing claws 96 of the elastic arms 95 of the fitting assurance member 80 slightly ride over the top portions of the beak portions 35 of the male housing 20 and reaches the pull-in surfaces 37 side.

When the female housing 50 is fitted to the male housing 20, the fitting assurance member 80 is brought into contact with the pull-in surfaces 37 of the beak portions 35 by the pressing claws 96 of the elastic arms 95 reached positions slightly above the top portions of the beak portions 35 of the male housing 20. Then, the pressing claws 96 are pressed against the pull-in surfaces 37 by the elastic forces of the elastic arms 95. As a result, pull-in forces for pulling the fitting assurance member 80 toward the male housing 20 are generated in the elastic arms 95, and the pull-in forces are applied to the fitting assurance member 80.

At this time, the outer surface which is the flat surface of the lock piece 64 is disposed inside the top position of the locking projection 32. Therefore, since the fitting assurance member 80 is pulled toward the male housing 20, the locking claw 91 of the locking arm 90 that reaches the boundary between the locking projection 32 and the lock piece 64 smoothly rides over the lock piece 64 without being hooked by the lock piece 64.

Figure 12A:
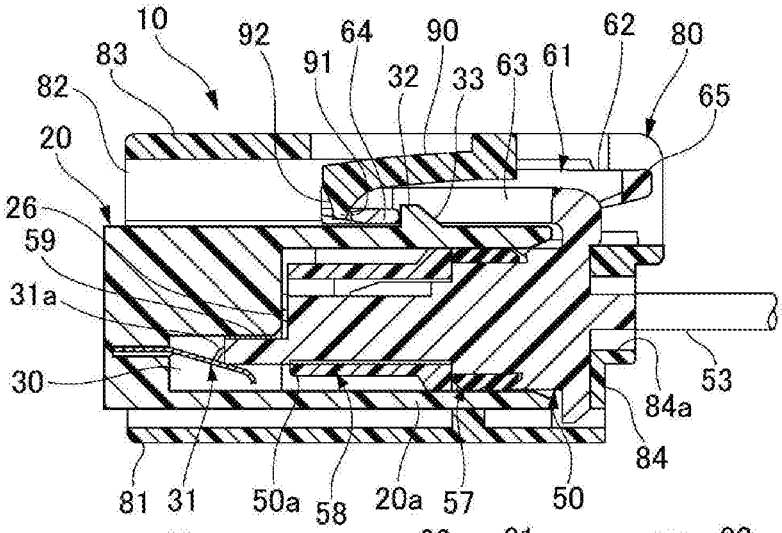
FIGS. 12A to 12C are views showing a state of the connector during the fitting operation.
Figure 12B:
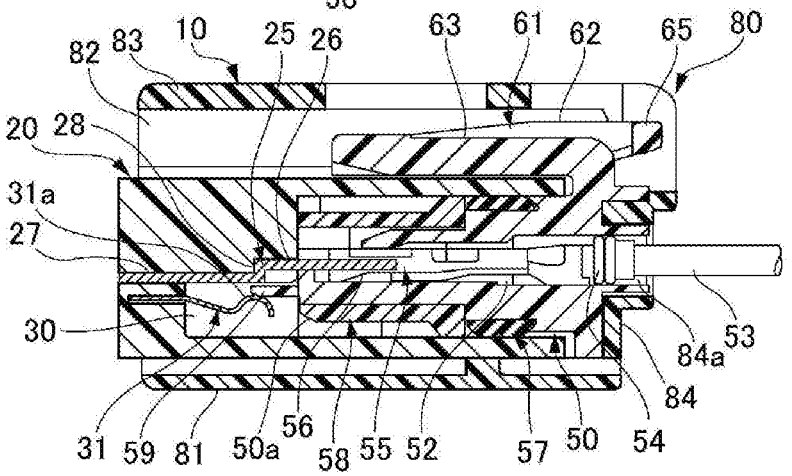
Figure 12C:
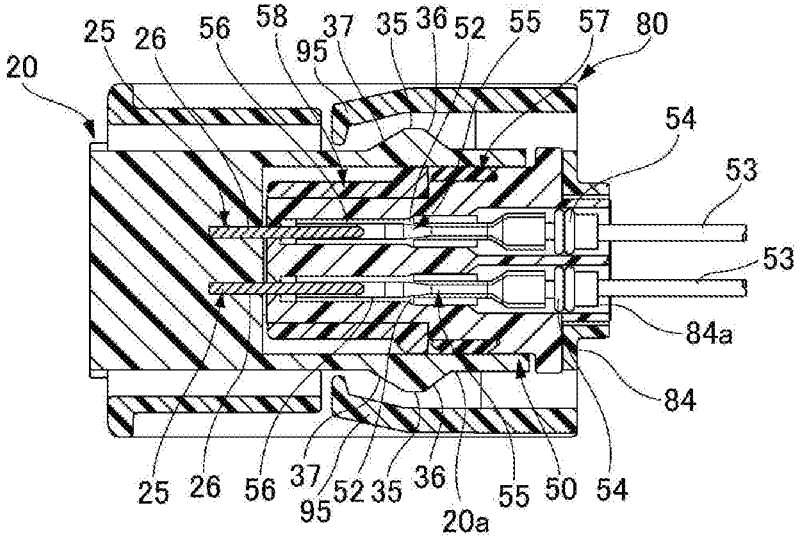

Then, as shown in FIGS. 12A to 12C, in the fitting assurance member 80, the locking claw 91 of the locking arm 90 rides over and locks the lock piece 64 that locks the locking projection 32 (see FIG. 12A). As a result, the fitting state between the male housing 20 and the female housing 50 is assured by the fitting assurance member 80 in the connector 10.

Next, a case in which the fitting assurance member 80 is removed and the male housing 20 and the female housing 50 in the fitting state are separated from each other in the connector 10 having the above-described structure will be described.

FIGS. 13A to 13C and 14A to 14C are views showing changes in the state of the connector during the separating operation.

Figure 13A:
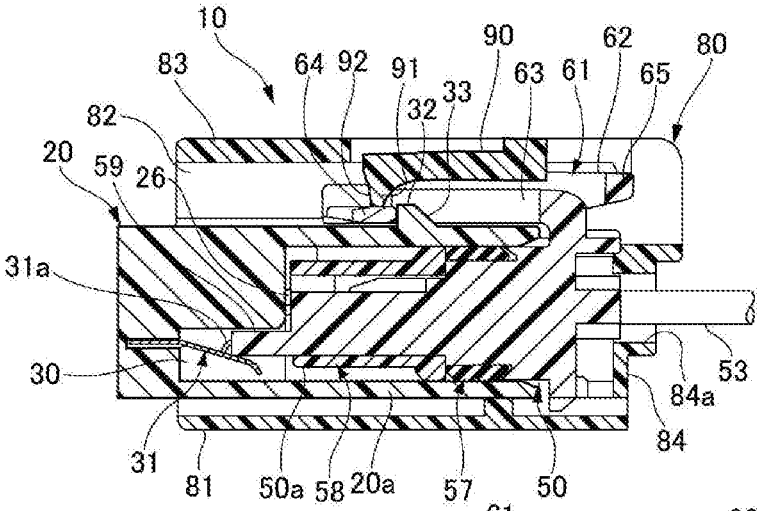
FIGS. 13A to 13C are views showing a state of the connector during a separating operation.
Figure 13B:
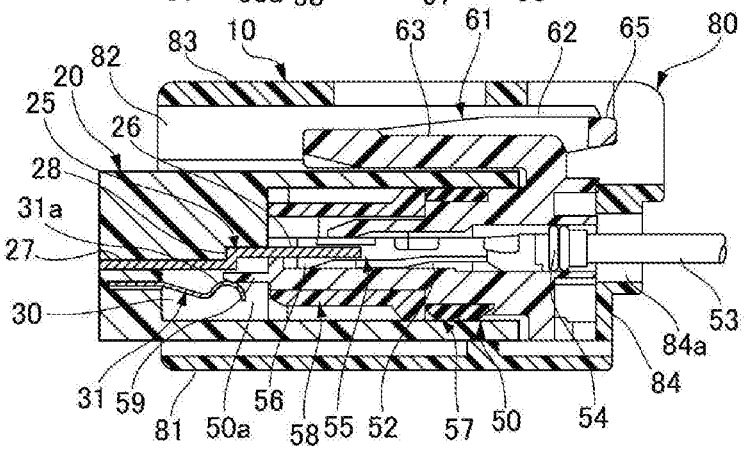
Figure 13C:
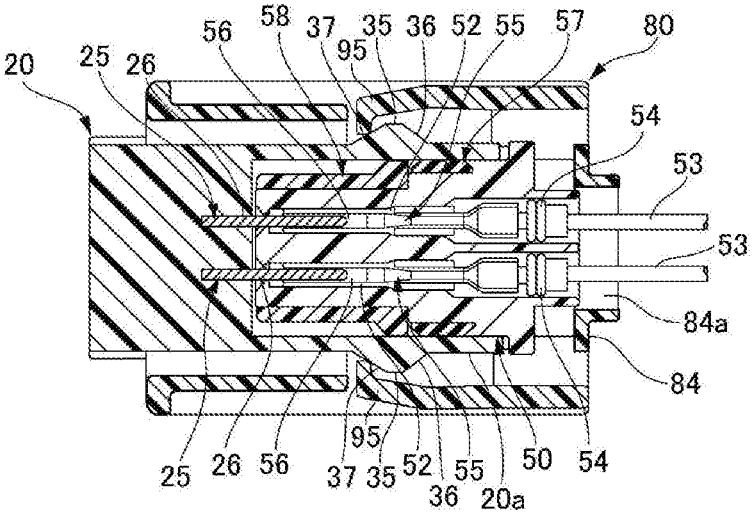

In order to separate the male housing 20 and the female housing 50, first, as shown in FIGS. 13A to 13C, the fitting assurance member 80 is moved to the rear side of the female housing 50. Then, the locking claw 91 of the locking arm 90 locked the lock piece 64 is disengaged from the lock piece 64 (see FIG. 13A). At this time, the pressing claws 96 of the elastic arms 95 of the fitting assurance member 80 are brought into contact with the pull-in surfaces 37 of the beak portions 35 of the male housing 20 (see FIG. 13C).

Figure 14A:
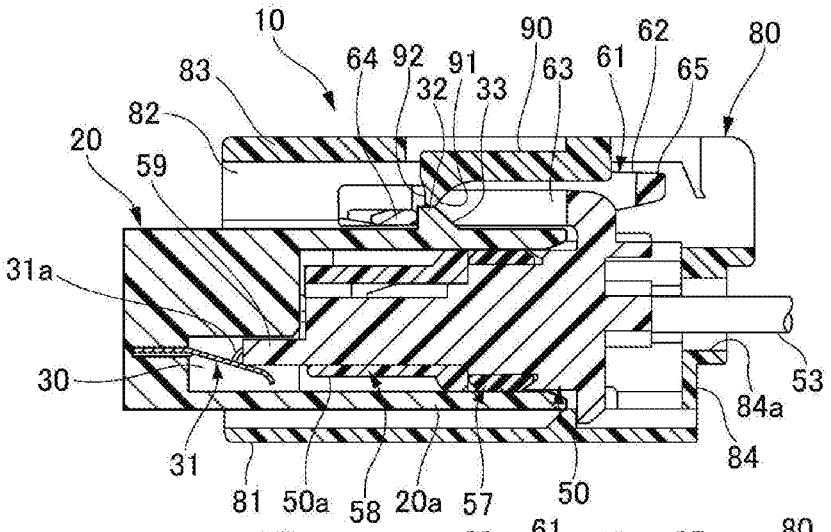
FIGS. 14A to 14C are views showing a state of the connector during the separating operation.
Figure 14B:
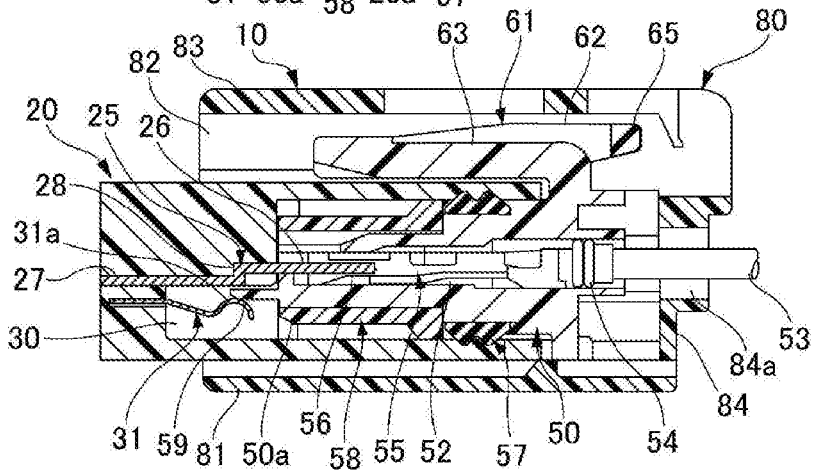
Figure 14C:
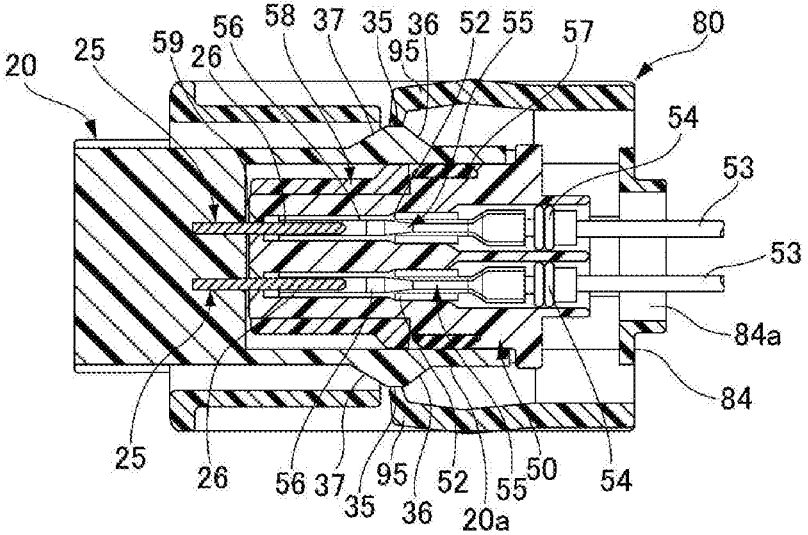

Thereafter, as shown in FIGS. 14A to 14C, the fitting assurance member 80 is further moved toward the rear side of the female housing 50. Then, the locking claw 91 of the locking arm 90 is disengaged from the locking projection 32 (see FIG. 14A). The pressing claws 96 of the elastic arms 95 are disposed on the push-back surfaces 36 side over the top portions of the beak portions 35 of the male housing 20 (see FIG. 14C).

As described above, when the fitting assurance member 80 is moved to the rear end side of the female housing 50, the pressing claws 96 of the elastic arms 95 smoothly slide on the pull-in surfaces 37 of the beak portions 35 without being hooked by the beak portions 35 and ride over the top portions thereof. When the pressing claws 96 of the elastic arms 95 ride over the break portions 35 and reach the push-back surfaces 36, the pressing claws 96 are pressed against the push-back surfaces 36 by the elastic forces of the elastic arms 95. As a result, a repulsive force toward the rear of the female housing 50 is applied to the fitting assurance member 80. Therefore, the fitting assurance member 80 can be easily separated.

When the fitting assurance member 80 is moved to the rear of the female housing 50, the operation portion 65 of the lock member 61 of the female housing 50 is pushed down. Then, the swing frame portion 62 swings to elastically deform the lock arm 63, and the lock piece 64 is disengaged from the locking projection 32. Therefore, in this state, by pulling out the female housing 50 from the male housing 20, the male housing 20 and the female housing 50 are separated, and the electrical connection state between the male terminal 25 and the female terminal 55 is released.

As described above, according to the connector according to the present embodiment, when the female housing 50 is fitted to the male housing 20 and the locking claw 91 of the locking arm 90 reaches the boundary between the locking projection 32 and the lock piece 64, the pressing claws 96 of the elastic arms 95 of the fitting assurance member 80 are over the top portions of the break portions 35 and disposed on the sides of the pull-in surfaces 37. As a result, the pressing claws 96 are guided along the pull-in surfaces 37, whereby the elastic arms 95 are pulled toward the male housing 20. Therefore, the feeling of hooking when the locking claw 91 of the locking arm 90 passes through the boundary between the locking projection 32 and the lock piece 64 can be made less likely to be felt by the operator. As a result, fitting operation can be smoothly performed by the operator.

Moreover, since the outer surface of the lock piece 64 in which the locking projection 32 is locked is disposed inside the top portion of the locking projection 32, the locking claw 91 of the locking arm 90 passes smoothly between the locking projection 32 and the lock piece 64. As a result, the feeling of hooking can be made less likely to be felt by the operator.

In addition, when the pressing claws 96 of the pair of elastic arms 95 of the fitting assurance member 80 is in contact with the pair of beak portions 35 provided on the opposite sides of the outer peripheral surface of the male housing 20, the repulsive forces and the pull-in force can be generated in a balanced manner.

In the above embodiment, the case where the male housing 20 is provided in the device 1 such as an inflator is illustrated, but the male housing 20 may have a structure in which a male terminal connected to an electric wire is accommodated in a terminal housing chamber.

The present invention is not limited to the embodiment described above, and may be appropriately modified, improved, or the like. In addition, the material, shape, size, number, arrangement position, or the like of each component in the above-described embodiment are optional and are not limited as long as the present invention can be achieved.

Figure 15:
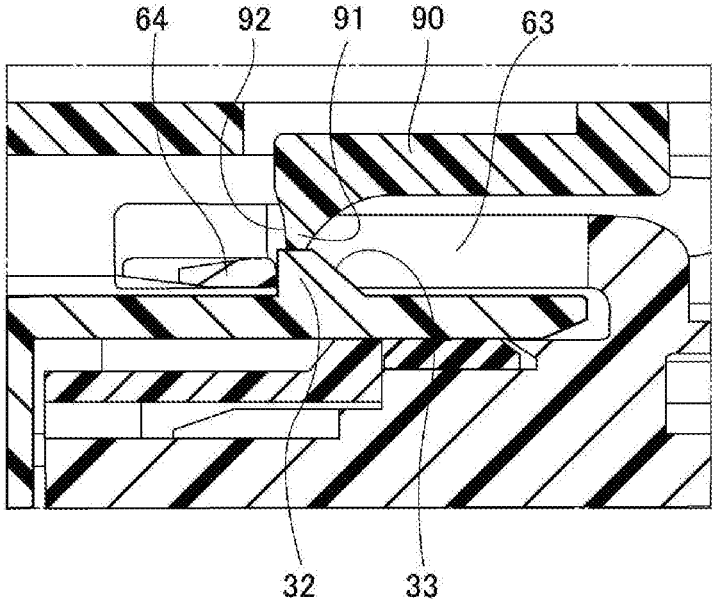
FIG. 15 is a cross-sectional view of a lock piece and the vicinity thereof showing another shape of the lock piece.

For example, as shown in FIG. 15, the outer surface of the lock piece 64 may be an inclined surface that inclines inward gradually toward the front side in the fitting direction to the male housing 20. In this way, the locking claw 91 of the locking arm 90 reached the boundary between the locking projection 32 and the lock piece 64 can be guided to the front of the female housing 50 by the inclined outer surface of the lock piece 64. As a result, the feeling of hooking the locking claw 91 at the boundary between the locking projection 32 and the lock piece 64 can be made less likely to be felt by the operator.

Further, characteristics of the embodiments of the connector according to the present invention described above are briefly summarized in the following [1] to [4], respectively.

[1] A connector which is a connector 10 including a first housing (male housing 20), a second housing (female housing 50) fitted to the first housing (male housing 20), and a fitting assurance member 80 assembled to the second housing (female housing 50) to assure a fitting state of the second housing (female housing 50) with respect to the first housing (male housing 20), in which the first housing (male housing 20) includes a locking projection 32 and a beak portion 35 projecting outward from an outer peripheral surface, respectively, in which the second housing (female housing 50) includes a lock arm 63 having a lock piece 64 locked with the locking projection by getting over the locking projection 32 when the second housing is fitted with the first housing (male housing 20), in which the fitting assurance member 80 includes a locking arm 90 having a locking claw 91 for riding over and locking the locking projection 32 and the lock piece 64 locked the locking projection 32 while pressing the lock piece 64 to ride over the locking projection 32, and an elastic arm 95 that elastically deforms since the pressing claw 96 at the front end is brought into contact with the beak portion 35 to generate a repulsive force in a direction separating from the first housing (male housing 20) during fitting of the second housing (female housing 50) with respect to the first housing (male housing 20), in which the beak portion 35 includes a push-back surface 36 inclined outward gradually toward the rear side of the first housing (male housing 20) on the front side of the first housing (male housing 20) with the top portion as a boundary, and a pull-in surface 37 inclined inward gradually toward the rear side of the first housing (male housing 20) on the rear side of the first housing (male housing 20), and in which the pressing claw 96 of the elastic arm 95 is disposed over the top portion of the beak portion 35 and on the pull-in surface 37 side when the locking claw 91 of the locking arm 90 reaches a boundary between the locking projection 32 and the lock piece 64 that locks the locking projection 32.

[2] The connector according to [1], in which an outer surface of the lock piece 64 that locks the locking projection 32 is disposed inside the top portion of the locking projection 32.

[3] The connector according to [1] or [2], in which the outer surface of the lock piece 64 is an inclined surface that inclines inward gradually toward the front side of the second housing (female housing 50).

[4] The connector according to any one of [1] to [3], in which the first housing (male housing 20) is provided with a pair of the beak portions 35 on opposite sides of an outer peripheral surface, and the fitting assurance member 80 is provided with a pair of the elastic arms 95 having the pressing claws 96 respectively in contact with the beak portions 35.

What is claimed is:

1. A connector comprising:

a first housing, a second housing that is fitted to the first housing, and a fitting assurance member that is assembled to the second housing to assure a fitting state of the second housing with respect to the first housing, wherein the first housing includes a locking projection which projects outward from an outer peripheral surface of the first housing, and a beak portion which projects outward from the outer peripheral surface of the first housing, wherein the second housing includes a lock arm having a lock piece locked with the locking projection by getting over the locking projection when the second housing is fitted with the first housing, wherein the fitting assurance member includes a locking arm having a locking claw for riding over and locking the locking projection and the lock piece that locks the locking projection while pressing the lock piece to ride over the locking projection, and an elastic arm that is elastically deformed when a front end of a pressing claw is brought into contact with the beak portion during fitting of the second housing with respect to the first housing so as to generate a repelling force in a direction separating from the first housing, wherein the beak portion includes a push-back surface provided on a front side of the first housing with a top portion of the beak portion as a boundary and inclined outward gradually toward a rear side of the first housing, and a pull-in surface provided on the rear side of the first housing with the top portion of the beak portion as a boundary and inclined inward gradually toward the rear side of the first housing, and wherein the pressing claw of the elastic arm is disposed on the pull-in surface side over the top portion of the beak portion when the locking claw of the locking arm reaches a boundary between the locking projection and the lock piece that locks the locking projection.

2. The connector according to claim 1, wherein in the lock piece that has locked with the locking projection, an outer surface of the lock piece is disposed inside the top portion of the locking projection.

3. The connector according to claim 2, wherein the outer surface of the lock piece is an inclined surface that inclines inward gradually toward the front side of the second housing.

4. The connector according to claim 1, wherein the first housing is provided with a pair of beak portions on facing surfaces opposed to each other in an outer peripheral surface of the first housing, and the fitting assurance member is provided with a pair of elastic arms having pressing claws respectively in contact with the beak portions.

* * * * *